US006398597B1

(12) United States Patent
Ko

(10) Patent No.: US 6,398,597 B1
(45) Date of Patent: Jun. 4, 2002

(54) RECEPTACLE CONTACT OF A CABLE ASSEMBLY AND THE CABLE ASSEMBLY USING THE SAME

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/780,063

(22) Filed: Feb. 9, 2001

(51) Int. Cl.[7] ..... H01R 13/11
(52) U.S. Cl. ..... 439/858; 439/752.5
(58) Field of Search ..... 439/858, 733.1, 439/752.5, 861, 607

(56) References Cited

U.S. PATENT DOCUMENTS 2,503,559 A * 4/1950 Miloche ..... 439/858
5,743,771 A * 4/1998 Yamaguchi et al. ..... 439/752.5
5,749,753 A * 5/1998 Chishima et al. ..... 439/752.5
6,146,215 A * 11/2000 Matsushita et al. ..... 439/752.5
6,174,208 B1 * 1/2001 Chen ..... 439/752.5

FOREIGN PATENT DOCUMENTS

SU 1394294 * 5/1988 ..... 439/858

* cited by examiner

*Primary Examiner*—Gary Paumen
(74) *Attorney, Agent, or Firm*—Wei Te Chung

(57) ABSTRACT

A receptacle contact (1A) comprises a main body (1), an intermediate curved section (2), a cantilever section (21), and a guiding tab (22). The intermediate curved section (2) extends curvedly from the main body (1) and circumambulates an axis (100) which is parallel to an extension direction of the main body (1). The cantilever section (21) extends initially toward the main body (1) for a predetermined distance and then extends away from the main body (1) and terminates as a bent-out end (211) thereby defining an opening (10) between the bent-out end (211) and the main body (1). The guiding tab (22) extends from the intermediate curved section (2) toward the circumambulated axis for guiding the receptacle contact (1A) to be loaded into a connector housing (6).

2 Claims, 6 Drawing Sheets

RECEPTACLE CONTACT OF A CABLE ASSEMBLY AND THE CABLE ASSEMBLY USING THE SAME

BACKGROUND OF THE INVENTION

1. Field of the Invention

The present invention relates to a receptacle contact of a cable assembly, particularly to a receptacle contact having a guiding means formed at an intermediate portion thereof for facilitating insertion of the receptacle contact into a connector housing.

2. The Prior Art

Receptacle contacts are commonly used for connection between high frequency devices for preventing electromagnetic interference occurred between the connection point of the high frequency devices. Normally, this kind of receptacle contacts have a deep socket formed by multi-walls for receiving a complementary terminal after they are loaded into and fixed in a connector housing. However, the receptacle contact, due to the length of the deep socket thereof and the multi-walls of its structure, is apt to be blocked by inner walls of the connector housing when it is loaded into the connector housing for fixation. Although some of the receptacles are formed with a guiding portion at a tip thereof for ease of insertion into the connector housing, the receptacles are still apt to be blocked by the inner walls of the connector housing due to its multi-walls and considerable length of loading-in. It is requisite to provide a new receptacle contact for overcoming the loading-in problem.

SUMMARY OF THE INVENTION

The primary purpose of the present invention is to provide a receptacle contact for ease of loading-in with respect to a connector housing.

One aspect of the present invention is to provide a receptacle contact which comprises a main body, an intermediate curved section, a cantilever section, and a guiding tab. The intermediate curved section extends curvedly from the main body and circumambulates an axis which is parallel to an extension direction of the main body. The cantilever section extends initially toward the main body for a predetermined distance and then extends away from the main body and terminates as a bent-out end thereby defining an opening between the bent-out end and the main body. The guiding tab extends from the intermediate curved section toward the circumambulated axis for guiding the receptacle contact to be loaded into a connector housing.

Another aspect of the present invention is to provide a cable assembly comprising an insulative insert having a plurality of slits defined in a front face thereof, a connector housing and a plurality of receptacle contacts each of which is fixed to a corresponding one of the slits. Each receptacle contact comprises a main body, an intermediate curved section extending curvedly from the main body and circumambulating an axis which is parallel to an extension direction of the main body, a cantilever section extending initially toward the main body for a predetermined distance and then extending away from the main body and terminated as a bent-out end thereby defining an opening between the bent-out end and the main body, and a guiding tab extending from the intermediate curved section toward the circumambulated axis for guiding the receptacle contact to be located in the connector housing.

DETAILED DESCRIPTION OF THE PREFERRED EMBODIMENT

Figure 4:
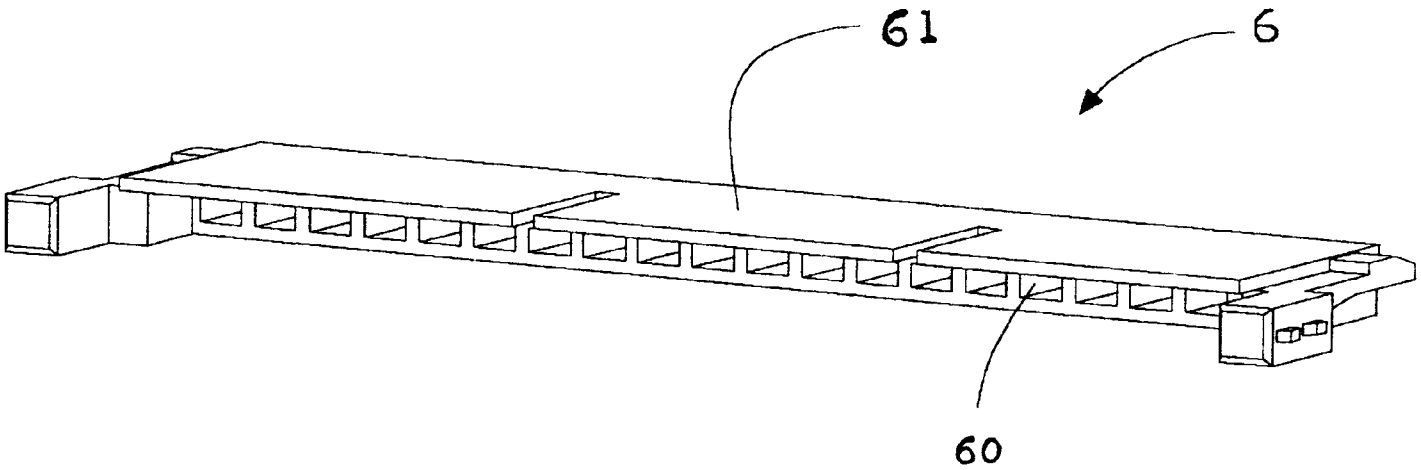
FIG. 4 is a connector housing for receiving the receptacle contacts already fixed to the insulative insert.
Figure 5:
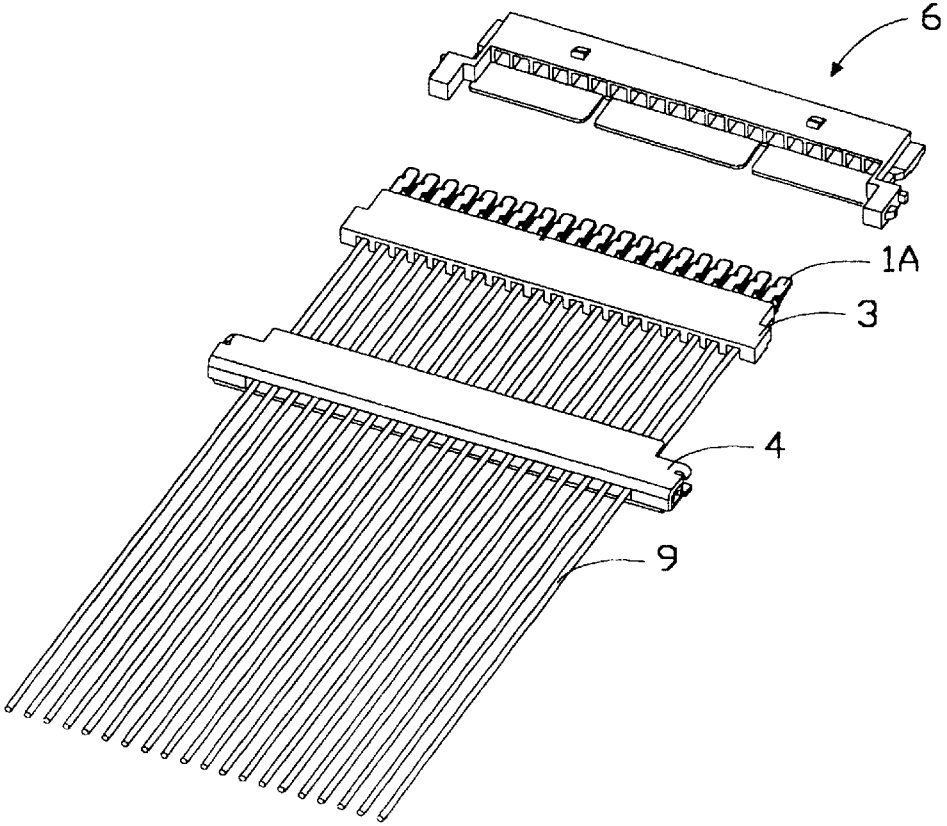
FIG. 5 is an exploded view of a cable assembly in accordance with the present invention.
Figure 6:
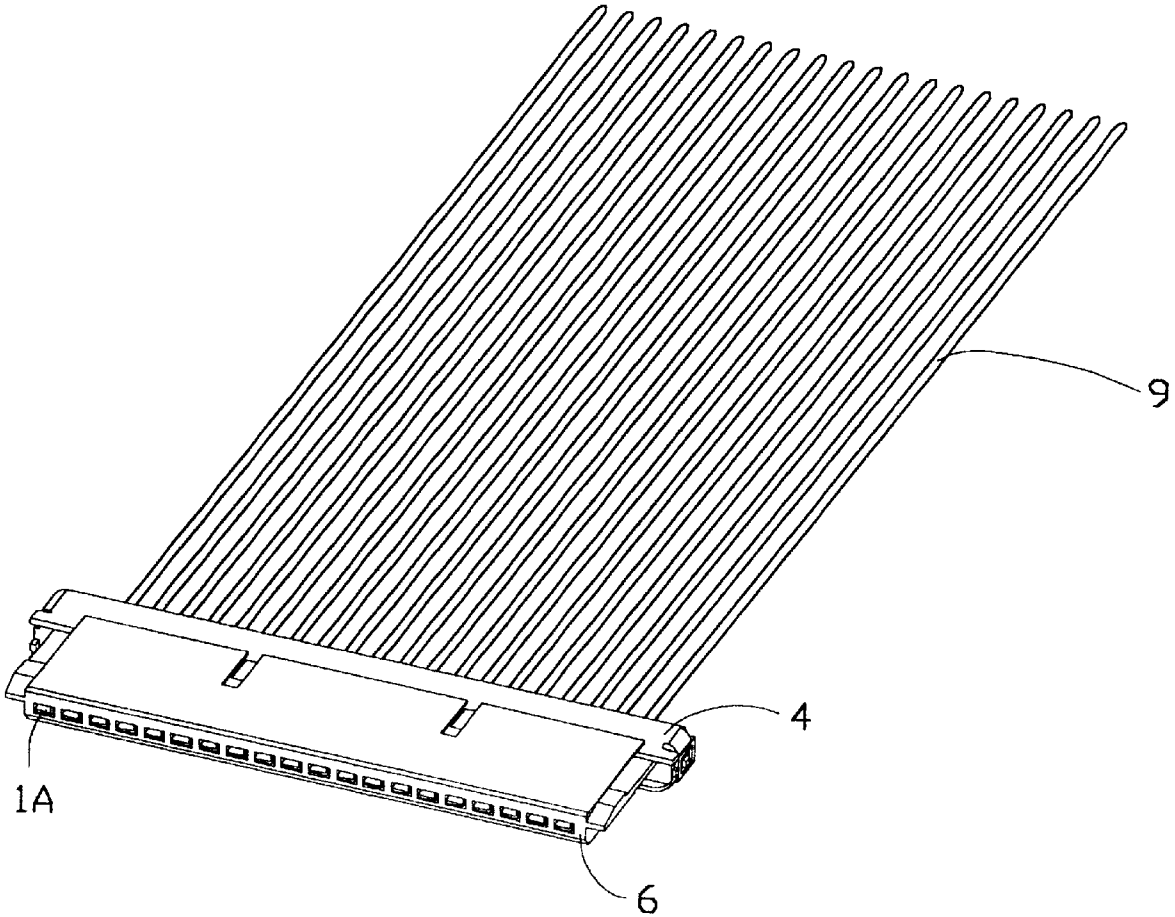
FIG. 6 is an assembled view of FIG. 5.

Referring to FIG. 5, a cable assembly in accordance with the present invention comprises a connector housing 6, an insulative insert 3 attached with a plurality of receptacle contacts 1A, a plurality of micro coaxial cables 9 electrically connected to the receptacle contacts 1A, and a metal shielding 4 adapted to be engaged with the insulative insert 3 and the connector housing 6 after the insulative insert 6 has been engaged with the connector housing 6. FIG. 6 illustrates an assembled view of the cable assembly taken from an opposite direction of FIG. 4. The details of the receptacle contact 1A, the connector housing 6, and the insulative insert 3 will be explained by the accompanied FIGS. 1, 2, 3, and 4.

Figure 1:
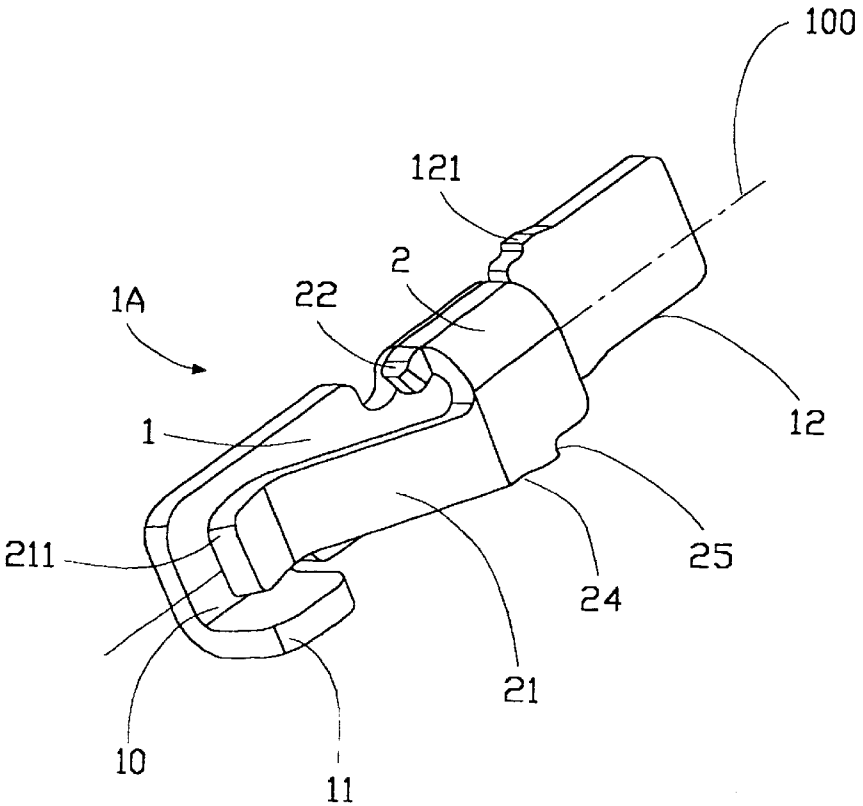
FIG. 1 is a perspective view of a receptacle contact in accordance with the present invention.

Referring to FIG. 1, the receptacle contact 1A in accordance with the present invention comprises a main body 1 extending along a lengthwise direction. The main body 1 has a guiding flange 11 extending from an edge portion thereof for guiding the main body 1 into the connector housing 6. The main body 1 also has an engagement plate 12 extending from one end thereof and having a barb 121 for engaging with the insulative insert 3 by which the receptacle contact 1A is inserted into the connector housing 6.

An intermediate curved section 2 extends curvedly from a middle edge portion of the main body 1 and circumambulates about an axis 100 which is parallel to an extension direction of the main body 1. The intermediate curved section 2 has a guiding edge 24 for guiding the receptacle contact 1A into the connector housing 6. A barb 25 is formed subsequent to the guiding edge 24 for retaining the receptacle contact 1A in the connector housing 6.

A cantilever section 21 extends initially toward the main body 1 for a predetermined distance and then extends away from the main body 1 and terminates as an bent-out end 211 thereby defining an opening 10 between the bent-out end 211 and the main body 1 for receiving a terminal of a complementary connector (not shown).

A guiding tab 22 extends from the intermediate curved section 2 toward the circumambulated axis 100 for guiding the receptacle contact 1A into the connector housing 6.

Figure 2:
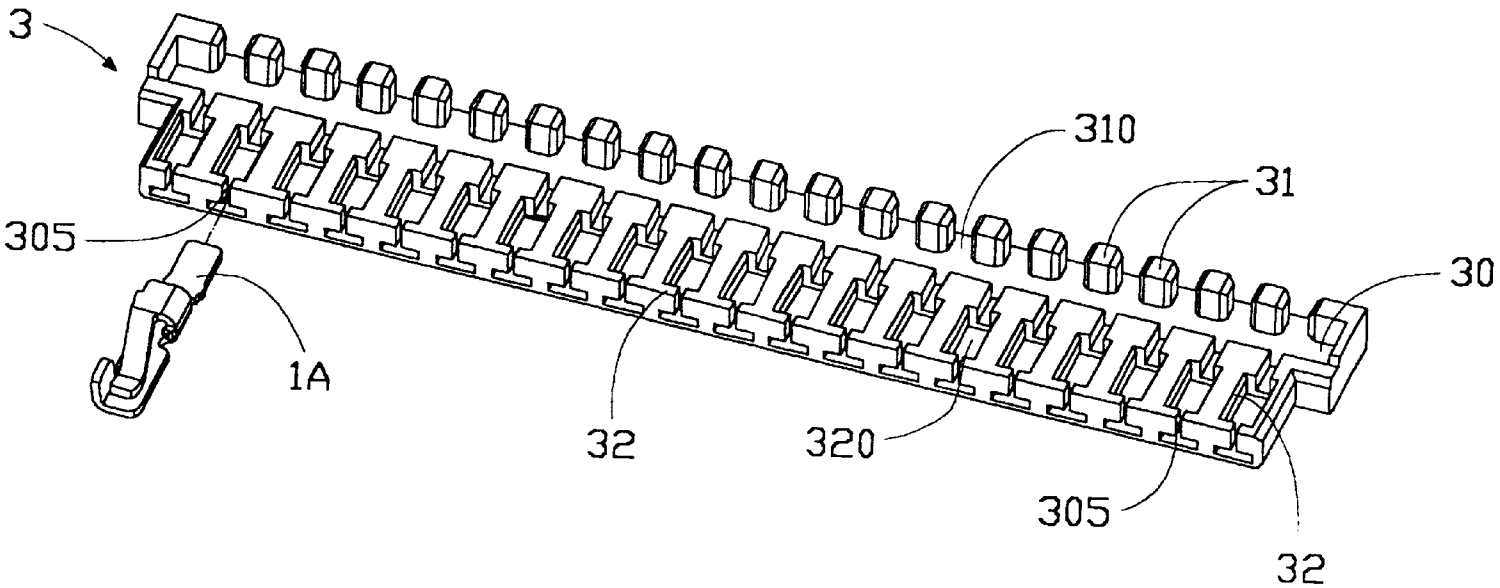
FIG. 2 is an insulative insert for fixing the receptacle contact before it is loaded into a connector housing.

Referring to FIG. 2, the insulative insert 3 has a base plate 30 having a plurality of first ribs 31 projected and lined in a row along one side of the base plate 30 and defining a plurality of first channels 310 between adjacent first ribs 31. A plurality of second ribs 32 are projected and lined in a row along an opposite side of the base plate 30 and defining a plurality of second channels 320 between adjacent second ribs 32, where each second channel 320 has a relatively wide center portion and two relatively narrow end portions. A plurality of slits 305 are defined at a front face of each adjacent pair of the second ribs 32 and each slit 305 is in communication with a corresponding one of the second channels 320. Each receptacle contact 1A is attached to the insulative insert 3 by inserting the engagement plate 12 thereof into the slit 305, with the barb 121 thereof being forcibly engaged with an inner side wall (not shown) of the slit 305.

Figure 3:
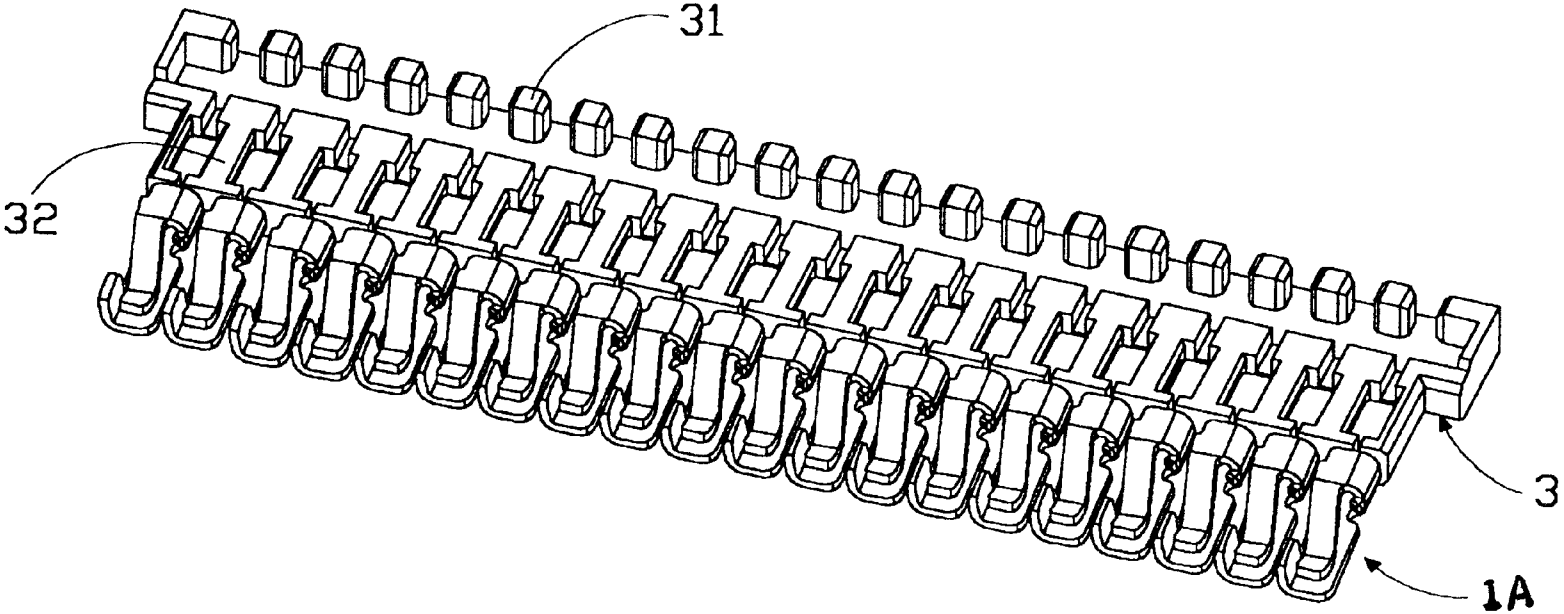
FIG. 3 is an assembled view of the receptacle contacts and the insulative insert.

Referring to FIG. 3, a plurality of the receptacle contacts 1A are attached to the insulative insert 3 and shown in a different angle from those shown in FIG. 5. After the receptacle contacts 1A have been configured to the insulative insert 3, a plurality of micro coaxialcables 9 are electrically soldered to the engagement plates 12 of the receptacle contacts 1A thus forming the configuration as shown in FIG. 5.

Referring to FIG. 4, the connector housing 6 comprises a flange 61 extending therefrom and defines a plurality of passageways 60 therein for receiving the receptacle contacts 1A. After the receptacle contacts 1A are inserted into the passageways 60 of the connector housing 6, the metal shielding 4 is then configured to the insulative insert 3 and the connector housing 6 thereby resulting to the cable assembly as shown in FIG. 6.

In this embodiment, the engagement plate 12 is received within the corresponding channel 320, and the rest of the contact 1A including the contact portion defined by the cantilever section 21 and the main body 1, is received within the corresponding passageway 60, under the condition that the insert 3 and the housing 6 abuts against each other in a front-t-back direction to form the whole assembly with the contacts fully embedded therein.

While the present invention has been described with reference to a specific embodiment, the description is illustrative of the invention and is not to be construed as limiting the invention. For example, the ribbon cable may be replaced with a flexible flat cable and the piercing contacts may be replaced with half bellow contacts for electrically contacting with the flexible flat cable. Therefore, various modifications to the present invention can be made to the preferred embodiment by those skilled in the art without departing from the true spirit and scope of the invention as defined by the appended claims.

What is claimed is:

1. A receptacle contact comprising:

a main body;

an intermediate curved section extending curvedly from the main body and circumambulating an axis which is parallel to an extension direction of the main body;

a cantilever section extending initially toward the main body for a predetermined distance and then extending outward from the main body and terminated as a bent-out end thereby defining an opening between the bent-out end and the main body;

a guiding tab extending from the intermediate curved section toward the circumambulated axis for guiding the receptacle contact to be located in a connector housing;

wherein the intermediate curved section has a guiding edge for guiding the receptacle contact to be located in the connector housing;

wherein the main body has a guiding flange extending from an edge portion thereof for guiding the main body into the connector housing;

wherein the main body has an engagement plate extending from one end thereof and having a barb for engaging with an insert by which the contact is inserted into the connector housing;

wherein the intermediate curved section has a barb formed subsequent to the guiding edge for retaining the receptacle contact in the connector housing.

2. A cable assembly comprising:

an insulative insert having a plurality of slits defined in a front face thereof;

a connector housing; and a plurality of receptacle contacts each of which is fixed to a corresponding one of the slits, and each receptacle contact comprising a main body, an intermediate curved section extending curvedly from the main body and circumambulating an axis which is parallel to an extension direction of the main body, a cantilever section extending initially toward the main body for a predetermined distance and then extending away from the main body and terminated as a bent-out end thereby defining an opening between the bent-out end and the main body, a guiding tab extending from the intermediate curved section toward the circumambulated axis for guiding the receptacle contact to be located in the connector housing;

wherein the intermediate curved section of the receptacle contact has a guiding edge for guiding the receptacle contact to be located in the connector housing;

wherein the main body of the receptacle contact has a guiding flange extending from an edge portion thereof for guiding the main body into the connector housing;

wherein the main body of the receptacle contact has an engagement plate extending from one end thereof and having a barb for engaging with an insert by which the contact is inserted into the connector housing;

wherein the intermediate curved section has a barb formed subsequent to the guiding edge for retaining the receptacle contact in the connector housing;

further comprising a metal shielding connected to the insulative insert and the connector housing.

* * * * *